United States Patent [19]

Marcus

[11] 4,101,710

[45] Jul. 18, 1978

[54] SILVER COMPOSITIONS

[75] Inventor: Sanford Morton Marcus, Wilmington, Del.

[73] Assignee: E. I. Du Pont de Nemours and Company, Wilmington, Del.

[21] Appl. No.: 775,274

[22] Filed: Mar. 7, 1977

[51] Int. Cl.[2] ..... H01B 1/08

[52] U.S. Cl. ..... 428/472; 428/434; 252/514; 252/519; 106/1.14

[58] Field of Search ..... 252/514, 513, 519; 75/170; 428/434, 427, 472; 106/1

[56] References Cited

U.S. PATENT DOCUMENTS

| | | | |
|---|---|---|---|
| 3,929,674 | 12/1975 | Patterson | 106/1 X |
| 3,943,168 | 3/1976 | Patterson | 252/519 |
| 3,970,590 | 7/1976 | Hoffman | 252/514 |

FOREIGN PATENT DOCUMENTS 2,617,226 11/1976 Fed. Rep. of Germany.

*Primary Examiner*—Richard E. Schafer
*Assistant Examiner*—E. Suzanne Parr

[57] ABSTRACT

Conductive silver compositions useful for producing in a single application step solderable metal coatings on titanate bodies especially semiconducting ceramic titanate bodies, the silver compositions comprising specific amounts of finely divided silver; boron, $Ni_3B$, and/or certain nickel boride/phosphides; and a binder which is glass and/or $PbF_2$. These inorganic solids are dispersed in an inert liquid vehicle. Also these compositions fired on a dielectric substrate.

15 Claims, No Drawings

SILVER COMPOSITIONS

CROSS-REFERENCE TO RELATED APPLICATION

The subject matter of this application invention is related in part to the nickel boride/phosphides disclosed in a copending, commonly assigned application filed on the same day as this application by Frank Knowles Patterson for Conductor Compositions application Ser. No. 775,273.

BACKGROUND OF THE INVENTION

This invention relates to electronics, and more particularly, to compositions useful for producing conductor patterns adherent to substrates.

Conductor compositions which are applied to and fired on dielectric substrates (glass, glass-ceramic, and ceramic) usually comprise finely divided inorganic powders (e.g., metal particles and binder particles) and are commonly applied to substrates using so-called "thick film" techniques, as a dispersion of these inorganic powders in an inert liquid medium or vehicle. Upon firing or sintering of the printed film, the metallic component of the composition provides the functional (conductive) utility, while the inorganic binder (e.g., glass, $Bi_2O_3$, etc.) bonds the metal particles to one another and to the substrate. Thick film techniques are contrasted with thin film techniques which involve deposition of particles by evaporation or sputtering. Thick film techniques are generally discussed in "Handbook of Materials and Processes for Electronics", C. A. Harper, Editor, McGraw-Hill, N.Y., 1970. Chapter 12.

Thermistors are typically ceramic resistor bodies whose electrical resistance is temperature dependent. Those whose resistances decrease with an increase in temperature are referred to as negative temperature coefficient (NTC) thermistors, while those whose resistances increase with an increase in temperature are referred to as positive temperature coefficient (PTC) thermistors. Thermistor bodies are generally bodies of fired ceramic semiconductors. In the case of the NTC thermistors, the latter are usually one or more metal oxides of a large group of metal oxides known to have semiconductive properties, some of the more commonly used being the oxides of metals such as manganese, nickel, cobalt, iron, zinc, vanadium, zirconium,-cerium, chromium and uranium. The PTC thermistor bodies generally are fired alkaline earth titanates which have been rendered semiconducting by the substitution of, for example, a small amount of a lanthanide (atomic number 57-71) or yttrium to yield compounds having the general formula $A_{1-x}B_xTiO_3$ where A is Ba, Ca, and/or Sr and B is the substituted atom. Often the titanate is lanthanium-doped barium titanate, $Ba_{1-x}La_xTiO_3$. Thermistors of both NTC and PTC types must be provided with electrically conductive contacts to which circuit leads may be attached.

The conductive contacts or electrodes applied to thermistor bodies should be low resistance, essentially ohmic contacts, especially for PTC bodies. Silver compositions are widely known and used for providing fired-on conductive contacts or electrodes on ceramic objects. However, most commercial silver compositions do not provide low resistance, ohmic contacts when fired onto semiconductive PTC bodies the reason apparently being that sufficient oxygen from the PTC body penetrates through the coating during firing to provide an oxidized nonconducting or barrier layer between the fired-on coating or electrode and the semiconductive substrate. Short U.S. Pat. No. 3,547,835 (issued Dec. 15, 1970 and incorporated by reference herein) provided silver conductive compositions which minimized the penetration of oxygen from the semiconducting body into the silver coating during firing, by adding certain amounts of aluminum to the silver composition. This material has been widely used commercially, but (as disclosed at col. 3, line 73 to col. 4, line 1 of U.S. Pat. No. 3,547,835) its fired coatings are not directly solderable. Of course, leads must be soldered onto the electrode to form a functional device. Hence a silver coating free of aluminum is applied over the Ag/Al coating of Short to permit soldering.

Low resistance contacts for semiconducting ceramics are reviewed by J. W. Fleming et al., *Ceramic Bulletin* 55, 715–6 (1976) and H. M. Landis, *Journal of Applied Physics* 36, 2000–2001 (1965). A two-step process for making contacts on semiconducting ceramics (flame-spray deposition of a layer of Al, then a layer of Cu) is disclosed in Kourtesis et al. U.S. Pat. No. 3,676,211.

There is a need for a silver material which can be applied to a semiconducting body in a single step and fired to produce a low-ohmic electrode which in both adherent and solderable, eliminating the significant expense of application of a second silver layer over the initial fired silver coating.

SUMMARY OF THE INVENTION

This invention provides conductive silver compositions of finely divided inorganic particles dispersed in an inert liquid vehicle, useful for producing in a single application step (followed by firing to sinter the inorganic particles) solderable electrodes adherent to ceramic titanate bodies. The compositions are especially useful on semiconducting titanate bodies. The inorganic particles are at least sufficiently finely divided to pass through a 400 mesh screen and consist essentially of about, by weight, either (A) (1) 75–98% silver, preferably 75–80%, more preferably 76%; (2) 2–6% boron, preferably 3–4%, more preferably 3%; and (3) 3–22% glass, $PbF_2$ or mixtures thereof, preferably 10–21%, more preferably 21%; or (B) (1) 40–70% silver, preferably 50–60%, more preferably 56%; (2) 25–60% $Ni_3B_{1-x}P_x$ (wherein $x$ is in the approximate range 0–0.6), preferably 25–40%, more preferably 30%; and (3) 3–22% glass, $PbF_2$ or mixtures thereof, preferably 10–21%, more preferably 14%. Mixtures of (A) and (B) may also be used. Component (3) in (A) and in (B) is preferably glass. Preferred compositions contain 60–80% inorganic particles and 20–40% vehicle. Also of this invention are ceramic titanate bodies having fired on and adherent thereto the above-described inorganic particles.

DETAILED DESCRIPTION

The compositions of this invention consist essentially of finely divided inorganic particles wherein silver serves as the conductive phase, boron or the above-described nickel borides serve to give the silver coating solderability and a resistance with low contact characteristics, and glass serves to increase adhesion to the substrate upon firing. $PbF_2$ may be used with or in lieu of glass as a binder. When used, it is thought that $PbF_2$ forms lead borate glass upon firing, by reacting with $B_2O_3$ produced on oxidation of boron. The relative proportions of the inorganic materials were selected to provide good conductivity, adherence and solderability.

Any conventional electronic glass may be used as the binder, as is well known to those skilled in the art, for example those of Larson & Short U.S. Pat. No. 2,822,279; Short U.S. Pat. No. 2,819,170; etc. Preferred among glasses are borates and borosilicates, especially lead borates and borosilicates.

Also incorporated by reference herein is Patterson U.S. Pat. No. 3,943,168, issued Mar. 9, 1976, disclosing, inter alia, $Ni_3B$ compositions.

While the inorganic particles are generally sufficiently finely divided to pass through a 400 mesh screen, it is preferred that substantially all the particles have a largest dimension of 5 microns or less.

The compositions may, of course, be modified by the addition of other materials not affecting their beneficial characteristics.

The inorganic particles are dispersed in an inert liquid vehicle by mechanical mixing (e.g., on a roll mill) to form a paste-like composition. The latter is printed as "thick film" on conventional dielectric substrates in the conventional manner. Any inert liquid may be used as the vehicle. Any of various organic liquids with or without thickening and/or stabilizing agents and/or other common additives, may be used as the vehicle. Exemplary of the organic liquids which can be used are the aliphatic alcohols; esters of such alcohols, for example, the acetates and propionates; terpenes such as pine oil, terpineol and the like, solutions of resins such as the polymethacrylates of lower alcohols, or solutions of ethyl cellulose, in solvents such as pine oil and the monobutyl ether of ethylene glycol monoacetate. The vehicle may contain or be composed of volatile liquids to promote fast setting after application to the substrate.

After drying to remove the vehicle, firing of the compositions of the present invention is carried out at temperatures and for times sufficient to sinter the inorganic materials and to produce conductor patterns adherent to the dielectric substrate. Firing is conducted at a temperature and for a duration sufficient to sinter the composition into an adherent, solderable coating which is electrically and physically continuous, according to principles well known to those skilled in the art. Firing may be conducted in a box or belt furnace, at a peak temperature in the range 550°–625° C., preferably at about 580° C. The peak temperature is maintained for at least 2 minutes, preferably about 10 minutes. Although firing will normally be conducted in air, firing in an inert atmosphere (e.g. nitrogen, argon, etc.) is possible.

Soldering of the fired electrodes to attach leads is done conventionally, e.g. by fluxing and then dipping in the molten solder described below.

Although special advantage is obtained by firing these compositions on semiconducting ceramic substrates of substituted barium titanate, the compositions are useful for producing conductive patterns on other ceramic titanate substrates such as barium titanate itself, etc.

EXAMPLES

The following examples and comparative showings are presented to illustrate this invention. Both herein and elsewhere in the specification and claims, all parts, percentages, ratios, etc., are by weight, unless otherwise specified. All screens are U.S. standard sieve scale.

The dielectric bodies used in this study were all semiconducting substituted barium titanate bodies and were of four different types. Each type had a different resistance when terminated by the multi-step state-of-the art techniques. The bodies had rated resistances of 1.1 ohm (18mm diameter by 2mm thick), 2 ohm (21mm diameter by 1mm thick), 23 ohm (15mm diameter by 3mm thick), and 26 ohm (8mm diameter by 3mm thick), respectively.

The glass used in these experiments contained 81.3% PbO, 12.2% $B_2O_3$, 1.1% $SiO_2$ and 5.4% $PbF_2$. The vehicle contained about 1 part ethyl cellulose and 9 parts terpineol. Silver, nickel boride, etc., are commercially available. $Ni_3B_{1-x}P_x$ was prepared by melting appropriate quantities of starting materials in an induction furnace under an atmosphere of purified argon at 1200°–1400° C. in a high purity alumina crucible. Peak temperature was generally 100°–300° C. above the temperature at when the charge was entirely molten. Once the charge became molten, it was held at that temperature for about 10 minutes. In some preparations the starting materials were Ni, B and $Ni_2P$; in others Ni, $Ni_3B$ and $Ni_2P$ were used. After the charge had cooled to an ingot, the latter ws comminuted to a particle size such that the resultant powder passed through at least a 400 mesh screen.

All of the inorganic materials were finely divided, and had the surface areas indicated below:

glass, 0.97–1.27 $m^2/g$.
silver, 0.75–1.35 $m^2/g$.
boron, 13 $m^2/g$.
$Ni_3B$, 0.8–1.2 $m^2/g$.
$Ni_3B_{0.9}P_{0.1}$, 1.1 $m^2/g$.

The $Ni_3B_{0.8}P_{0.2}$ and $Ni_3B_{0.4}P_{0.6}$ used in Examples 14 and 15 were milled and passed through a 400 mesh screen.

These inorganic powders in the proportions described below were dispersed in the above-described vehicle using a roll mill. The dispersions were then printed on one side of the substrate indicated below using a 165 mesh screen (substantially all of the surface was covered) and dried at 120° C. in air for 10 minutes. The other side was similarly printed and dried, and the composite was heated at 325° C. in air for 10 minutes to burn out vehicle and then fired in air at 580° C. for 10 minutes. All firing was done in preheated box furnaces, but equivalent results were obtained by first drying at 120° C. for 10 minutes and then firing in a belt furnace using a 60 minute cycle with 10 minutes at 580° C. peak.

In each case the fired coatings were adherent to the substrate and could well withstand handling. Leads were then attached to the fired electrodes by dipping for 10 seconds in a flux (20% tartaric acid/80% ethylene glycol) held at 220° C. and then dipping in 62Sn/36Pb/2Ag solder held at 220° C., 3 to 10 second dip. Resistance of the soldered body was determined using a 2-probe digital volt/ohmmeter.

Table 1 illustrates silver/boron compositions with glass binder. Showing A and Examples 1–3 illustrate the importance of the amount of boron in this invention. In Showing A (1.5% boron), resistance was too high, as compared with Examples 1–3 using 3–6% boron. Showing B illustrates the affect of too much binder (28%), high resistance and only fair solderability. In Showing C no binder was used resulting in no adhesion of silver coating to the substrate. In Examples 4, 5, 6, and 7 proportions of materials were varied.

In Table 2, Examples 8–12 illustrate the use of silver and various nickel borides. Showings D and E produced inferior results absent silver and will have greater tendency to oxidize upon longer firing. Showing F used no binder and was not solderable. Examples 11 and 12 illustrate two phosphorus-substituted nickel borides.

In Table 3 (Examples 13–16) binder of $PbF_2$ alone, or $PbF_2$ and glass, was used.

TABLE 1

| SILVER/BORON/GLASS | Example (No.) or Showing (Letter) | | | | | | | | | |
|---|---|---|---|---|---|---|---|---|---|---|
| | A | 1 | 2 | 3 | B | C | H | 5 | 6 | 7 |
| Silver, wt.% | 84.5 | 80 | 83 | 76 | 69 | 97 | 81.5 | 90 | 81.5 | 90 |
| Boron, wt.% | 1.5 | 6 | 3 | 3 | 3 | 3 | 4.5 | 3 | 4.5 | 3 |
| Glass, wt.% | 14.0 | 14 | 14 | 21 | 28 | — | 14 | 7 | 14 | 7 |
| Rated Resistance of body, ohms | 1.1 | 1.1 | 1.1 | 1.1 | 1.1 | 1.1 | 1.1 | 1.1 | 23 | 23 |
| Resistance found, ohms | 3.9 | 0.9 | 1.1 | 1.2 | 2.9 | —* | 1.1 | 0.9 | 14.3 | 14.4 |
| Solderability | good | fair | good | good | fair | — | good | good | good | good |

*Lacked adhesion to substrate

TABLE 2

| SILVER/NICKEL BORIDES/GLASS | Example (No.) or Showing (Letter) | | | | | | | |
|---|---|---|---|---|---|---|---|---|
| | 8 | 9 | D | E | 10 | F | 11 | 12 |
| Silver, wt.% | 49 | 56 | — | — | 50 | 70 | 56 | 56 |
| $Ni_3B$, wt.% | 30 | 30 | 86 | 72 | 40 | 30 | — | — |
| $Ni_3B_{0.8}P_{0.2}$, wt.% | — | — | — | — | — | — | 30 | — |
| $Ni_3B_{0.4}P_{0.6}$, wt.% | — | — | — | — | — | — | — | 30 |
| Glass, wt.% | 21 | 14 | 14 | 28 | 10 | — | 14 | 14 |
| Rated Resistance of body, ohms | 2 | 26 | 1.1 | 1.1 | 1.1 | 23 | 23 | 23 |
| Resistance found, ohms | 1.6 | 25 | 3.9 | 1.1 | 0.9 | 14 | 17.3 | 20.1 |
| Solderability | good | good | good | fair | fair | none | good | good |

TABLE 3

| SILVER/BORON/$PbF_2$ | Example No. | | | |
|---|---|---|---|---|
| | 13 | 14 | 15 | 16 |
| Silver, wt. % | 82 | 76 | 93 | 79 |
| Boron, wt. % | 3 | 3 | 3 | 3 |
| Glass, wt. % | 7.5 | 10.5 | — | — |
| $PbF_2$, wt. % | 7.5 | 10.5 | 4 | 18 |
| Rated Resistance of Body, ohms | 1.1 | 1.1 | 23 | 23 |
| Resistance found, ohms | 1 | 1 | 15.1 | 16.8 |
| Solderability | good | good | good | good |

I claim:

1. A conductive silver composition useful for producing in a single application step solderable metal coatings on ceramic titanate bodies, said silver compositions being a mixture of finely divided inorganic particles dispersed in a vehicle, the inorganic particles consisting essentially of about, by weight, (A) (1) 75–98% silver
(2) 2–6% boron, and
(3) 1–22% glass, $PbF_2$, or mixtures thereof, or
(B) (1) 40–70% silver,
(2) 25–60% $Ni_3B_{1-x}P_x$ wherein $x$ is in the approximate range 0–0.6, and
(3) 3–22% glass, $PbF_2$, or mixtures thereof, or
(C) mixtures of (A) and (B).

2. Compositions according to claim 1 wherein the inorganic particles consist essentially of (A).

3. Compositions according to claim 2 wherein (A) (3) is glass.

4. Compositions according to claim 2 wherein (A) (3) is $PbF_2$.

5. Compositions according to claim 2 wherein (A) consists essentially of about (1) 75–80% silver,
(2) 3–4% boron, and
(3) 10–21% glass, $PbF_2$ or mixtures thereof.

6. Compositions according to claim 5 of about (1) 76% silver,
(2) 3% boron, and
(3) 21% glass, $PbF_2$ or mixtures thereof.

7. Compositions according to claim 1 wherein the inorganic particles consist essentially of (B).

8. Compositions according to claim 7 wherein (B) (3) is glass.

9. Compositions according to claim 7 wherein (B) (3) is $PbF_2$.

10. Compositions according to claim 7 wherein (B) consists essentially of about (1) 50–60% silver,
(2) 25–40% said $Ni_3B_{1-x}P_x$,
(3) 10∝21% glass, $PbF_2$ or mixtures thereof.

11. Compositions according to claim 10 consisting essentially of about (1) 56% silver,
(2) 30% said $Ni_3B_{1-x}P_x$, and
(3) 14% glass, $PbF_2$, or mixtures thereof.

12. Compositions according to claim 1 of 60–80% inorganic particles and 20–40% vehicle.

13. Ceramic titanate bodies having adherent thereto a sintered electrode of the composition of claim 1.

14. Ceramic titanate bodies having adherent thereto a sintered electrode of the composition of claim 2.

15. Ceramic titanate bodies having adherent thereto a sintered electrode of the composition of claim 7.

* * * * *